US006441293B1

(12) United States Patent
LaBarbera

(10) Patent No.: US 6,441,293 B1
(45) Date of Patent: Aug. 27, 2002

(54) SYSTEM FOR GENERATING PERCUSSION SOUNDS FROM STRINGED INSTRUMENTS

(76) Inventor: Anthony LaBarbera, 425 Maditon Ave., #83, New Milford, NJ (US) 07646

( * ) Notice: Subject to any disclaimer, the term of this patent is extended or adjusted under 35 U.S.C. 154(b) by 0 days.

(21) Appl. No.: 09/672,254

(22) Filed: Sep. 28, 2000

Related U.S. Application Data

(60) Provisional application No. 60/200,566, filed on Apr. 28, 2000.

(51) Int. Cl.[7] ..... G10H 3/00
(52) U.S. Cl. ..... 84/723; 84/290
(58) Field of Search ..... 84/723, 742, 290, 84/291

(56) References Cited

U.S. PATENT DOCUMENTS 3,375,747 A * 4/1968 Posey
3,665,490 A * 5/1972 Oskar
3,680,423 A * 8/1972 Lander
5,105,711 A * 4/1992 Barnard
5,403,972 A * 4/1995 Valentine, Sr. ..... 84/743 X
5,900,573 A * 5/1999 Barnes ..... 84/746
6,166,307 A * 12/2000 Caulkins et al.

* cited by examiner

*Primary Examiner*—Jeffrey Donels

(74) *Attorney, Agent, or Firm*—Morgan, Lewis & Bockius LLP

(57) ABSTRACT

A music and percussion system is described including a fully functional stringed hollow-body electric musical instrument, a floor unit, an interface unit, and connecting cables. The instrument includes a microphone, a pickup, and a plurality of transducers, also known as acoustic drum triggers, that are mounted on selected interior surfaces within the instrument neck and body. By using a playing technique that combines strumming with tapping on the instrument neck or body, an instrumentalist is able to play the instrument strings and to simultaneously trigger sounds stored within a percussion synthesizer. Two transducers, each within a housing, are included in the floor unit. The instrumentalist may tap his or her feet on the housings to trigger additional sounds stored within the percussion synthesizer. Output signals from the instrument microphone, pickup, instrument transducers and floor unit transducers are transferred by appropriate electrical connections to the interface unit. The interface includes output jacks that provide connections to a mixer, preamp, and percussion synthesizer by standard cables. The interface also includes a switching component that switches drum sounds whenever the instrumentalist breaks an infrared beam that is transmitted from a sensor that is included in the floor unit. Certain switches included in the floor unit provide control of additional parameters of a percussion synthesizer including hi-hat position and patch selection. Units comprised of the inner components of the instrument described herein may be installed within existing stringed instruments.

28 Claims, 15 Drawing Sheets

Mixer
Instrument preamp
100a
trigger inputs
Percussion synthesizer
kick drum
kick drum
patch change
hi-hat controller
4PDT analog switch 130a
132a
128a
128b
120a
120b
Instrument internal mic. 56
Instrument magnetic pickup 62
Instrument triggers 16a-16d
Sensor 106a
Foot trigger 90a
Foot trigger 90b
Patch change switch / pedal 102
Hi-hat controller switch / pedal 104

SYSTEM FOR GENERATING PERCUSSION SOUNDS FROM STRINGED INSTRUMENTS

This application claims the benefit of provisional application 60/200,566 field Apr. 28, 2000.

FIELD OF THE INVENTION

The present invention relates to a musical instrument, and specifically to a hollow body stringed instrument with a system for generating percussion (drum) sounds, and a signal processing system to facilitate the simultaneous playing of the instrument strings and the triggering of sounds stored within a percussion synthesizer.

BACKGROUND OF THE INVENTION

In the genre of live musical performance, the solo guitarist, that is, one who prefers to be the sole live performer of music on a given stage, must do so without the pulse and beat of live percussion instrument sounds. The addition of percussion instrument sounds such as bongos, congas, or a full set of drums has been attainable through the addition of a live drummer or percussionist, or through the use of any of several commercially produced drum machines that, by design, limit the instrumentalist's musical spontaneity.

To accompany himself or herself, the solo musician may choose from many commercially produced drum machines, each containing a sequencer that is preprogrammed to regulate the tempo, meter, and drum selection of the percussion rhythm track it supplies. The use of these machines requires that the instrumentalist's performance and music follow the programmed rhythm track, and spontaneity is often sacrificed. Also, the meter that the drum machine supplies is thought by many to be mechanical sounding and devoid of the musical ebb and flow that is best achieved by a responsive, freely thinking, live musician. Furthermore, seeing and hearing their favorite music played by a machine may be less attractive to live audiences than having the same music being performed spontaneously and with all the nuances and improvisation of a live performance for the individuals of a given audience on a given date.

Several portable, hand playable percussion instruments designed for live performance and utilizing pressure-sensitive piezoelectric transducers have been made in prior art. Several of these inventions are found in U.S. patents to Stanton (U.S. Pat. No. 5,841,052), Valentine, Sr. (U.S. Pat. No. 5,403,972), Segan et al. (U.S. Pat. No. 5,121,668), Cole (U.S. Pat. No. 5,085,119), and Jones (U.S. Pat. No. 4,867,028). None of these patents include a functional stringed instrument in their designs. Other devices designed to accompany a fully functional guitar have been made in prior art. Several of these inventions are found in U.S. patents to Barnes (U.S. Pat. No. 5,900,573), Wakuda (U.S. Pat. No. 5,744,744), Hudak (U.S. Pat. No. 5,731,535), Barnard (U.S. Pat. No. 5,105,711), and Ibanez (U.S. Pat. No. 3,743,751).

In the Barnes patent, a device that is comprised of a striking member and a sound-producing base is mounted on the exterior shell of a guitar. The device is struck by the hand or by a foot pedal to produce a sound, much like installing a tiny cymbal with a hammer on it to produce a tapping, cymbal-like sound. The sounds produced by the mechanical device are limited to those that can be installed in the sound-producing base. The sounds produced by striking the device are described in the Barnes patent as washboard-like, castanet-like, cymbal-like, or drum-like. The device does not utilize transducers, nor does it have the capabilities to be connected to a percussion synthesizer. It cannot replicate the sounds of a full set of drums.

In the Wakuda, Hudak, and Barnard patents, hand-operated, onboard devices installed in or on the body of the guitar provide adjustment of parameters such as volume, vibrato, tremolo, echo, and other effects that are available in multiple effects units to which an instrument output is connected. The units described in these patents do not have the capabilities to trigger sounds from a percussion synthesizer.

In the Ibanez patent, a traditional, sequencer-controlled drum sound effects unit is installed in an electric guitar. The preprogrammed drumbeat of the unit must be followed by the player of the instrument. When playing the instrument, the instrumentalist does not have the capability to manually trigger drum sounds that are stored within a percussion synthesizer.

Several companies produce commercially available guitars or kits that work in conjunction with units commonly known as guitar synthesizers. These are electronic guitar systems designed to produce the sounds of woodwinds, brass and keyboard instruments. Guitar synthesizers utilize a pitch-to-MIDI technology that only responds to the well-executed picking or finger-picking of a string. Although they can produce MIDI note numbers that can trigger percussion sounds from within a guitar synthesizer module, stringed instruments that are fitted with guitar synthesizer drivers are not designed to be struck as a percussion instrument would be. Striking or tapping an instrument that utilizes present pitch-to-MIDI technology would produce glitches, unwanted notes, or noise. None of the guitar synthesizer systems are equipped to trigger percussion sounds acoustically through the use of pressure-sensitive piezoelectric transducers.

Consequently, for solo performers, a need exists for an instrument that expands the capabilities of a traditional stringed instrument to those of a string/percussion instrument, utilizing the instrumentalist's strumming and striking impact upon the hollow, wooden, drum-like structure that comprises the body of the instrument in conjunction with transducers that are employed to trigger full drum set and percussion sounds that are stored within a percussion synthesizer.

The invention described herein, when played using a tap/strum technique unique to the instrument of the present invention, provides the player of the instrument with the means to accompany the string music produced by the instrument with realistic percussion sounds played at the same time by a single instrumentalist.

SUMMARY OF THE INVENTION

Accordingly, the present invention is directed to a system to generate a percussion sound from a stringed instrument, a method of generating a percussion sound, and a stringed instrument including a transducer unit that substantially obviate one or more problems due to limitations and disadvantages of the related art.

According to one embodiment of the invention, a musical instrument system is described having a fully functional hollow-body electric stringed instrument with a microphone, pickup and a plurality of transducers, also known as acoustic drum triggers, mounted on selected interior surfaces within the instrument neck and body. Using a playing technique that combines strumming with rhythmic tapping on the instrument neck or body, an instrumentalist is able to play the instrument strings and to simultaneously trigger sounds stored within a percussion synthesizer that is used in conjunction with the present invention. Two freestanding foot transducers, each within a housing in the floor unit, are also connected to a percussion synthesizer. The instrumentalist may tap his or her feet on the housings to trigger additional sounds stored within the percussion synthesizer, usually those of a bass drum. Instrument microphone, pickup, and trigger output signals are transferred to an interface unit that includes output jacks that provide connections to a mixer, preamp, and percussion synthesizer by standard low impedance and ¼" patch cables.

In order to change drum sounds while playing, as a drummer on a conventional drum set may switch from playing the snare drum to the tom-toms for a "drum fill," the player of the instrument described herein may choose at any time to engage the switching component of the present invention. The switching component is an analog switch, FET switch, or relay that is housed within the system interface of the present invention and through which the instrument trigger output signals are transferred. The switching component alternates between a plurality of functions, with each function providing combinations of one or more instrument trigger outputs. The switching component alternates output functions when a signal is received from a sensor that is placed within the path of the instrumentalist's playing area. The signal is sent to the switching component whenever the instrumentalist breaks the invisible infrared beam that is transmitted from and reflected back to the sensor. Hence, when the instrumentalist chooses to move into the path of the sensor beam by altering his or her stance or posture slightly while he or she is playing the instrument, the switching component enables the outputs of the alternative function thereby enabling a different combination of sounds within the percussion synthesizer to be triggered by the instrumentalist tapping on the instrument of the present invention. Several switching components and sensors may be employed to provide additional output functions.

According to an aspect of the present invention, a microphone is included within the body of the instrument in the area of the instrument striking surfaces in order to amplify the strike of the instrumentalist's hand on the body of the instrument. A removable magnetic pickup with self-contained volume control is also included within the body of the instrument. Microphone and pickup output signals are transferred to the system interface through one or two output receptacles that are secured to the instrument body.

In the floor unit of this embodiment of the present invention are two foot pedals containing switches that provide control of patch changes and the opening and closing of the hi-hat sound within the percussion synthesizer. As used within the context of the present specification, patch refers to a group of sounds that are held together by a percussion synthesizer, and can be considered as being similar to a set of drums. This is not to be confused with patch cables, which is used herein in the conventional sense of a patch cable. The floor unit also includes the aforementioned foot triggers, sensor and electrical connections to the system interface unit. The floor unit is detachable to facilitate transportation and storage of the unit.

A wiring system comprised of multi-channel cable and multi-contact connectors is included in the present invention. It facilitates quick assembly and disassembly of the system described herein.

According to another aspect of the present invention, an instrument is provided with pressure-sensitive transducers that are installed under the instrument fingerboard and within the body of the instrument during its construction. Units comprised of the internal components of the instrument of the present invention that may be installed in existing hollow-body tenor, baritone and bass guitars as well as bass violins and most hollow-bodied stringed instruments are also described.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate embodiments of the invention and together with the description serve to explain the principles of the invention.

DETAILED DESCRIPTION OF THE INVENTION

Reference will now be made in detail to particular embodiments of the present invention, examples of which are illustrated in the accompanying drawings.

FIGS. 1–6 show perspective views of a guitar embodying the percussion triggering stringed instrument of the present invention.

Figure 1:
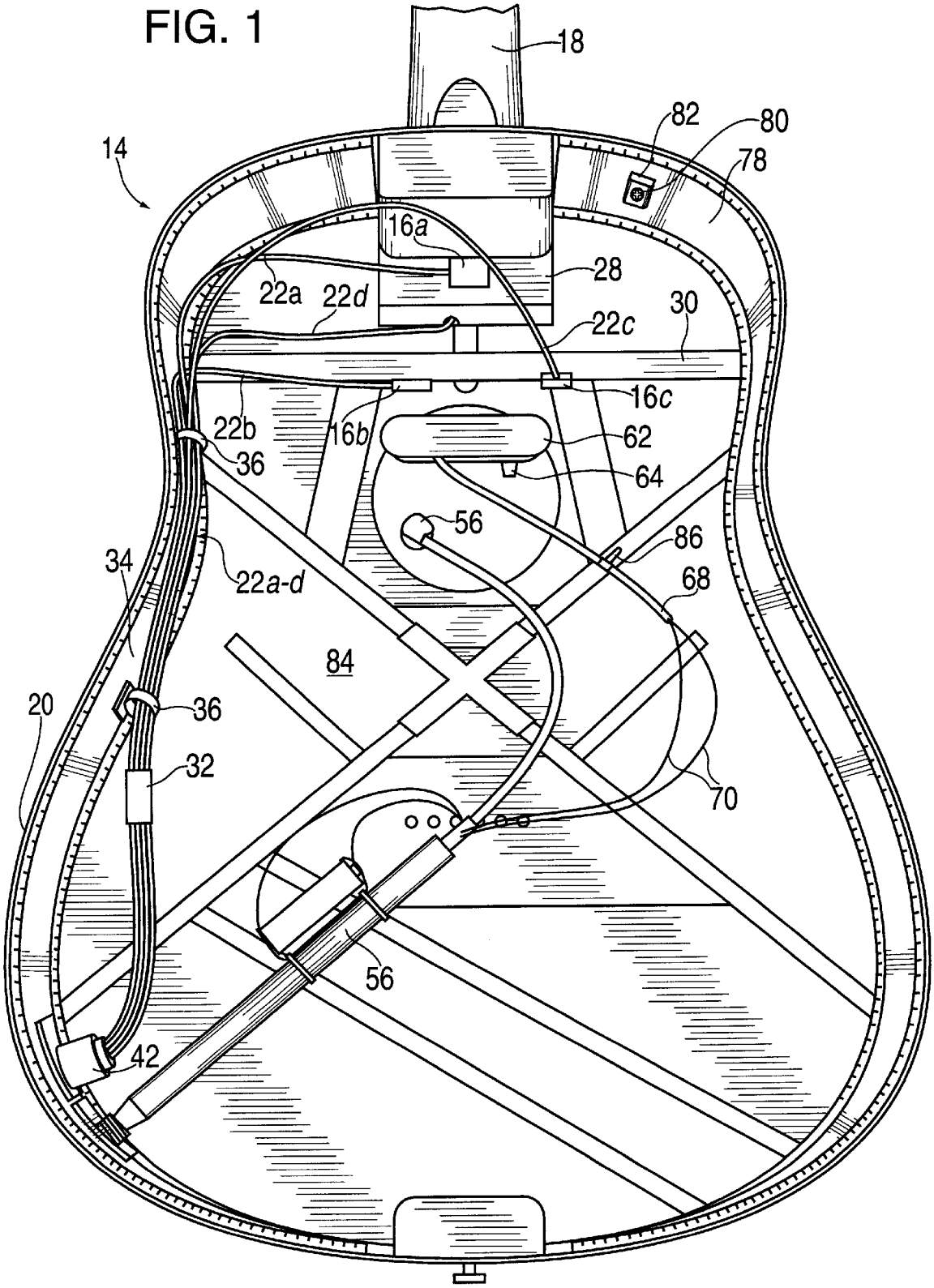
FIG 1 shows an interior view of a guitar embodying the percussion triggering stringed instrument of the present invention with back plate removed to show inner components of the instrument body.
Figure 2:
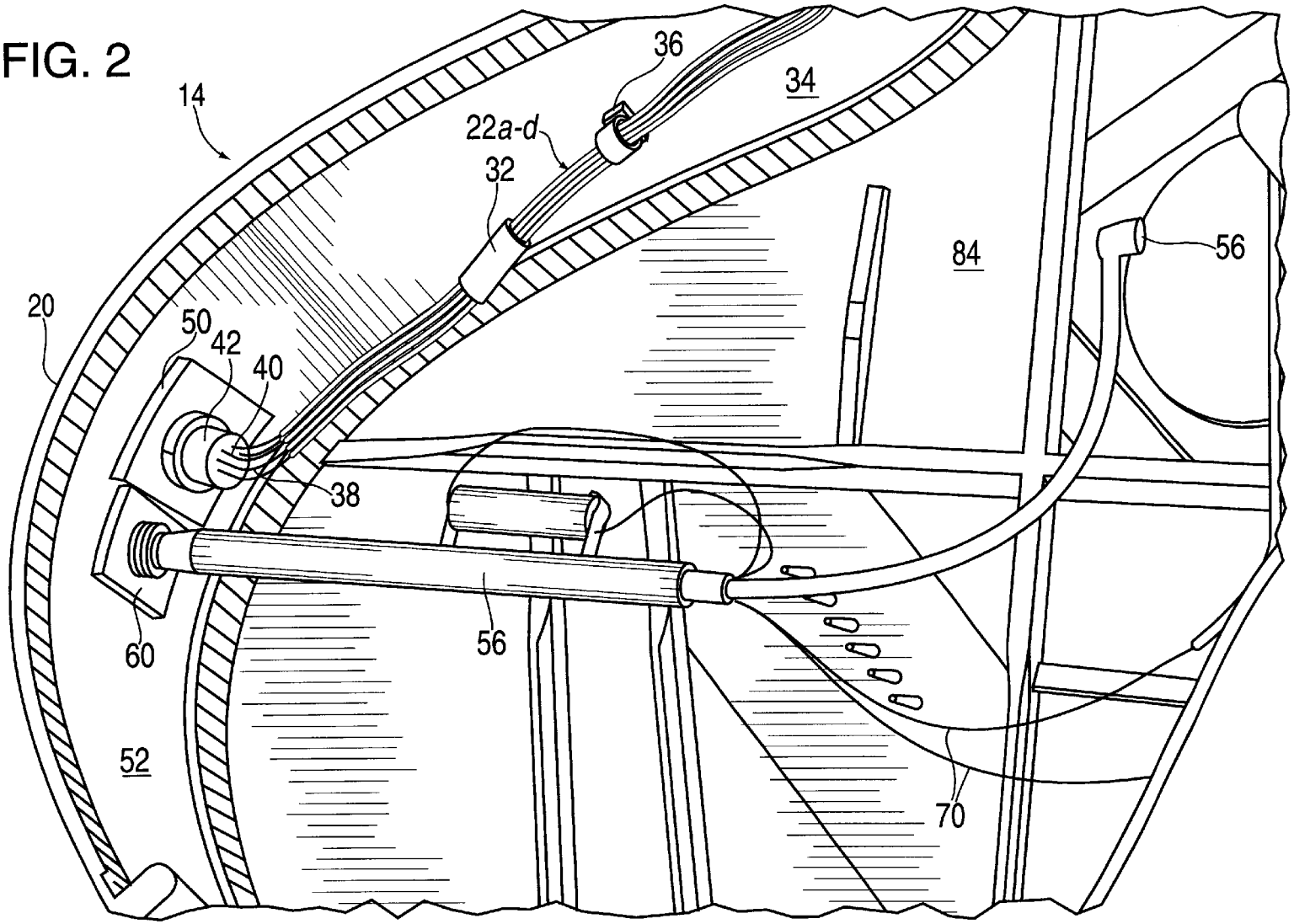
FIG. 2 shows a partial view of the interior of a guitar embodying the percussion triggering stringed instrument of the present invention with back plate removed detailing inner components of the instrument body.

FIGS. 1–2 show interior views of a guitar embodying the percussion triggering stringed instrument 14 of the present invention. A plurality of piezoelectric transducer triggers 16*a*–16*c* are mounted on selected interior surfaces within the instrument body 20. The piezoelectric transducer triggers are conventional in nature and are attached to the neck block 28 and instrument brace 30 in the pictured embodiment although they may be attached to any responsive area of the instrument of the present invention by a thin adhesive such as silicon epoxy. Transducer cables 22*a*–22*d* are bound by cable tie 32 and are secured to the interior side 34 by a plurality of cable clips 36. Transducer cable wires 38 are connected by beads of solder to appropriate contacts 40 of a locking multi-contact receptacle 42 such as the Switchcraft DF series, commercially available from Switchcraft, Inc., of Chicago, Ill. A reinforcer 50 supports the receptacle and is secured to the interior lower side 52 by a thin adhesive. A microphone 56, which in the preferred embodiment is a microphone such as the Mini-flex microphone, commercially available from Donnell Enterprises of Chico, Calif. is secured to the instrument body. A reinforcer 60 supports the microphone and is secured to the interior lower side of the instrument by a thin adhesive.

Figure 3:
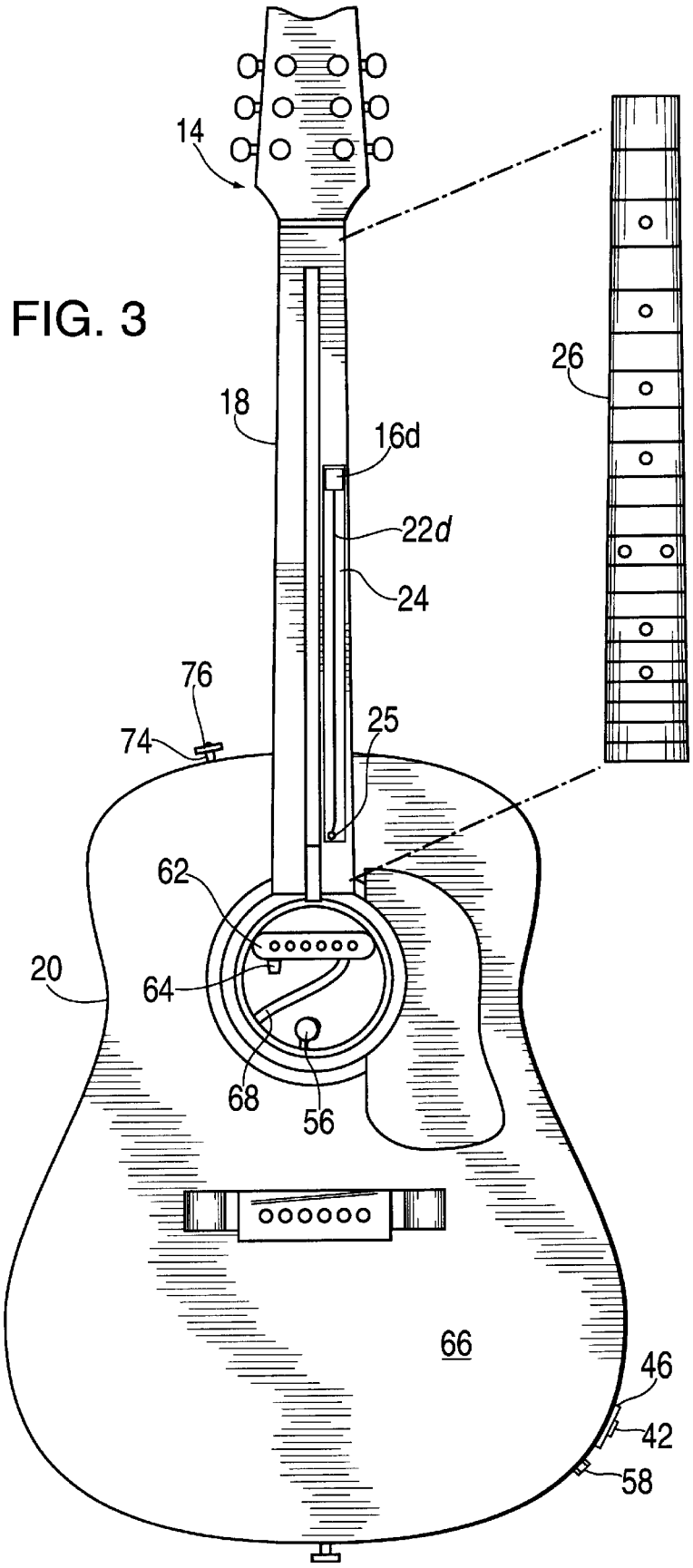
FIG. 3 shows a top front view of a guitar embodying the percussion triggering stringed instrument of the present invention with strings and fingerboard removed to show inner components of the instrument neck.

A removable magnetic pickup 62 with volume control 64 is secured to the instrument top 66 (FIGS. 1 and 3). The wires of the magnetic pickup 2-conductor output cable 68 are connected by beads of solder to the appropriate wires of the microphone coaxial cable 70 in order to output both the magnetic pickup and the microphone through the microphone ¼" 3-conductor output jack 72 shown in FIGS. 4–5. Self-adhesive cable clip 86 secures the pickup cable to the underside 84 of the instrument top and prevents the pickup cable from moving within the instrument body, thereby minimizing amplified noise caused by cables shifting within the body. A reinforcer 82 supports the strap post and is secured by wood screw 80 and by a thin adhesive to the interior of the instrument shoulder 78 (FIG. 1).

In FIG. 3, piezoelectric transducer trigger 16*d* and cable 22*d* sit within a tunnel 24 in the instrument neck 18 underneath the fingerboard 26 shown disconnected from the instrument neck in this drawing figure. Trigger cable 22*d* enters the instrument body 20 through a hole 25 in the instrument top 66. Strap post 74 with removable oversized top 76 is attached by a wood screw to the upper shoulder of the instrument. Removable magnetic pickup 62 with volume control 64 is shown secured to the instrument top. The magnetic pickup output cable 68 is also shown. Other types of pickup devices can also be used in the present invention. Microphone 56 is secured to instrument body by nut 58 and washer (not shown). Mounting panel 46 secures to the instrument body the multi-contact receptacle 42 through which instrument transducer output signals are transferred. Output signals from the instrument microphone, pickup, and transducers are transferred by appropriate electrical connections to the system interface.

Figure 4:
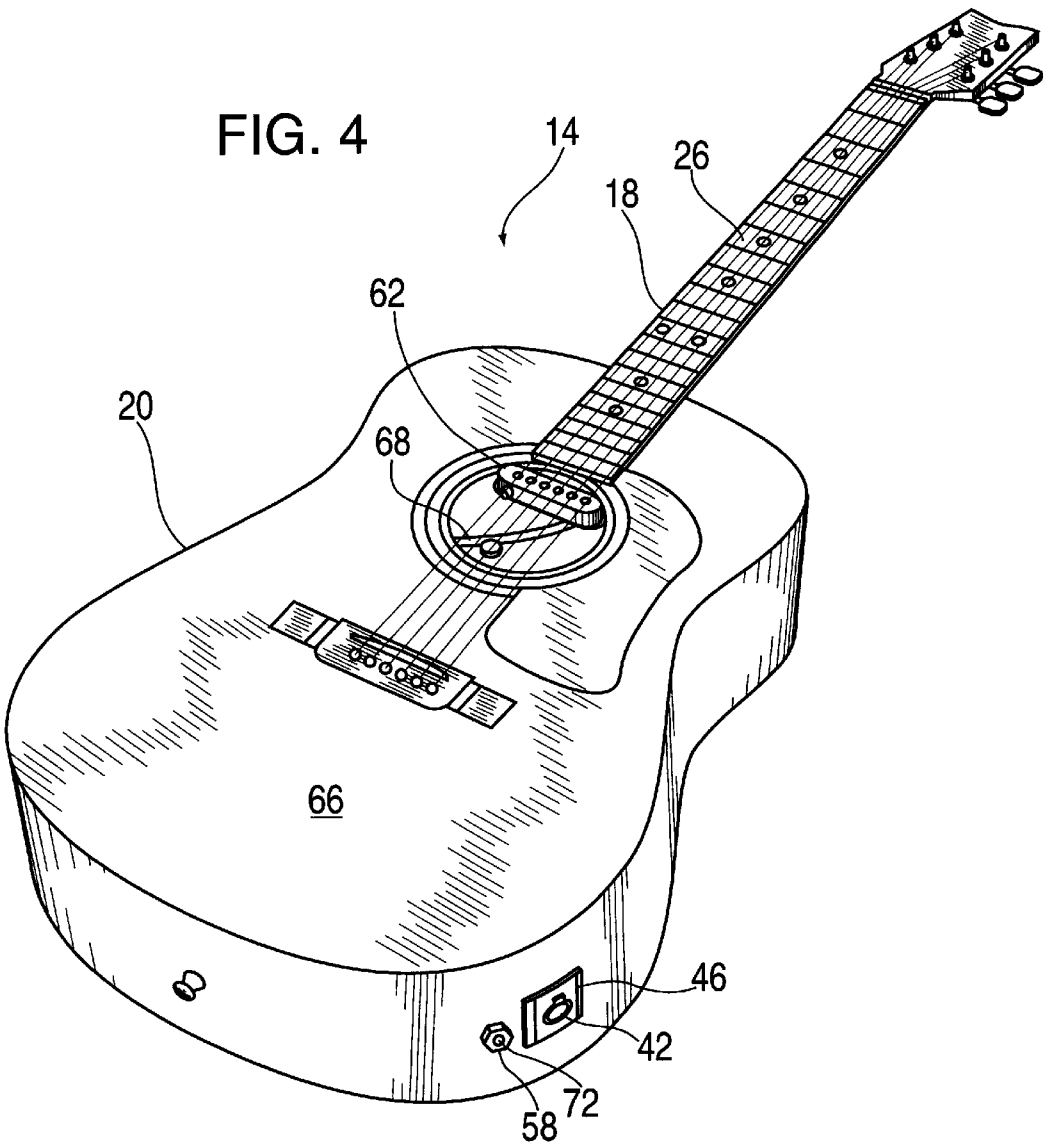
FIG. 4 shows a top tail-end view of a guitar embodying the percussion triggering stringed instrument of the present invention with fingerboard and strings intact.

FIG. 4 shows a top tail-end view of a guitar embodying the percussion triggering stringed instrument of the present invention with the instrument fingerboard 26 and strings intact.

Figure 5:
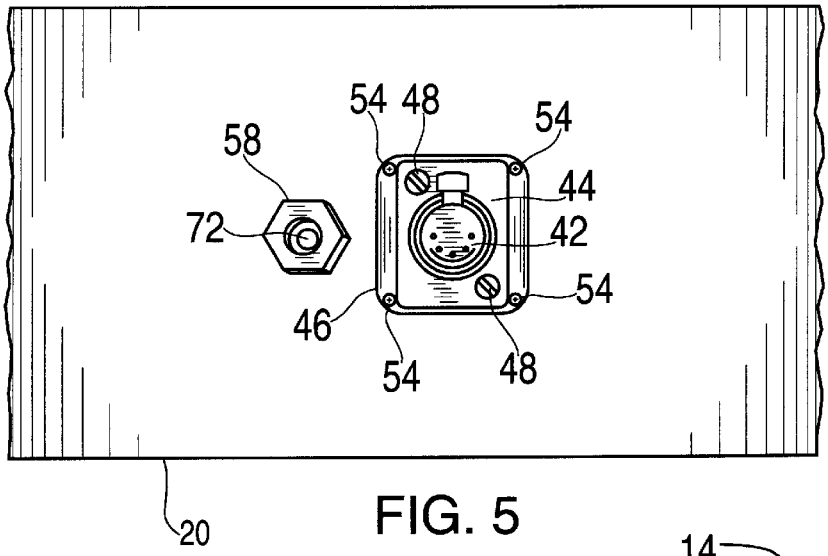
FIG. 5 shows a partial side view of a guitar embodying the percussion triggering stringed instrument of the present invention detailing output components of the instrument.

FIG. 5 details the output components located on the instrument side. Microphone ¼" 3-conductor output jack 72 with nut 58 is shown alongside the locking multi-contact receptacle 42. Receptacle flange 44 is fastened by two bolts 48 and matching nuts (not shown) to the mounting panel 46. A plurality of small wood screws 54 secure the mounting panel to the instrument body 20.

Figure 6:
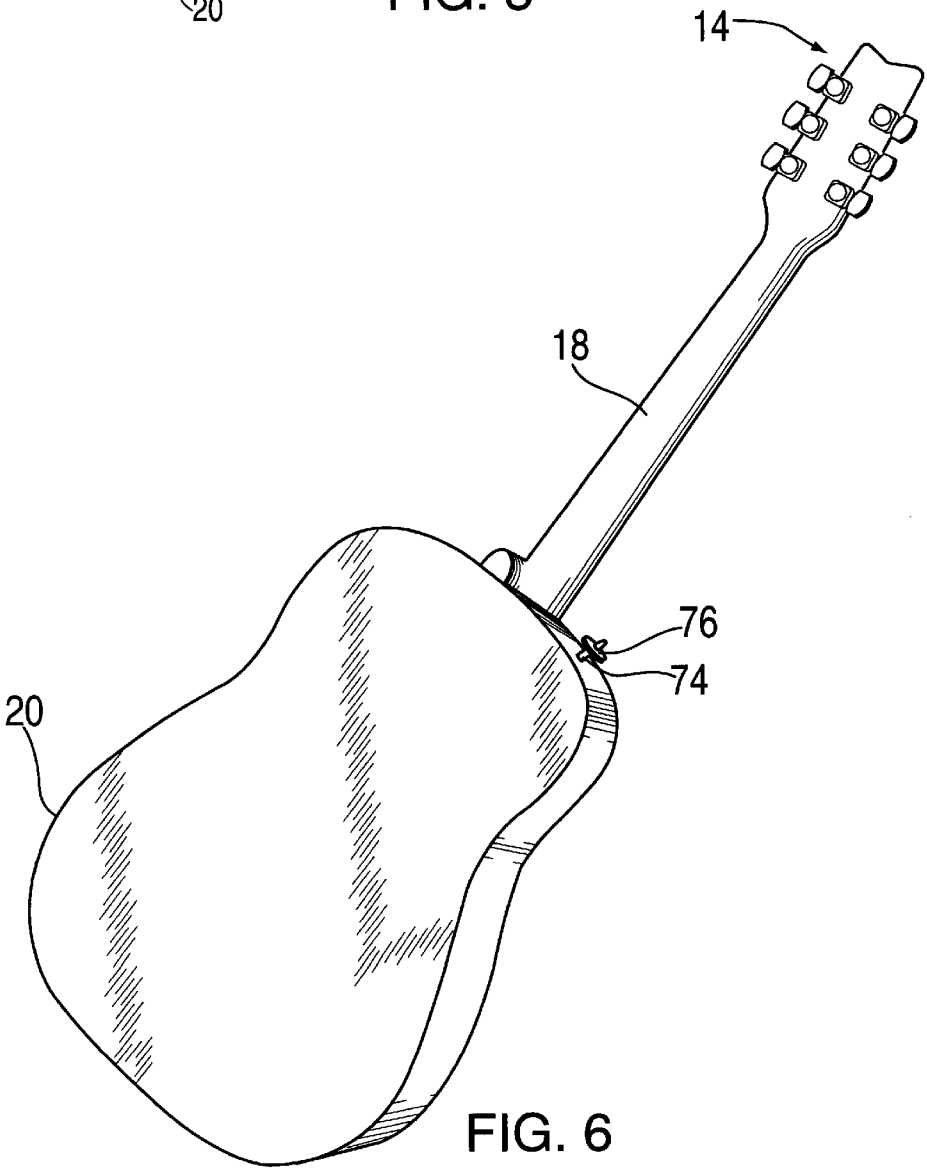
FIG. 6 shows a bottom side view of a guitar embodying the percussion triggering stringed instrument of the present invention.

FIG. 6 shows a bottom side view of a guitar embodying the percussion triggering stringed instrument 14 of the present invention and its strap post 74 with removable oversized top 76.

Figure 7:
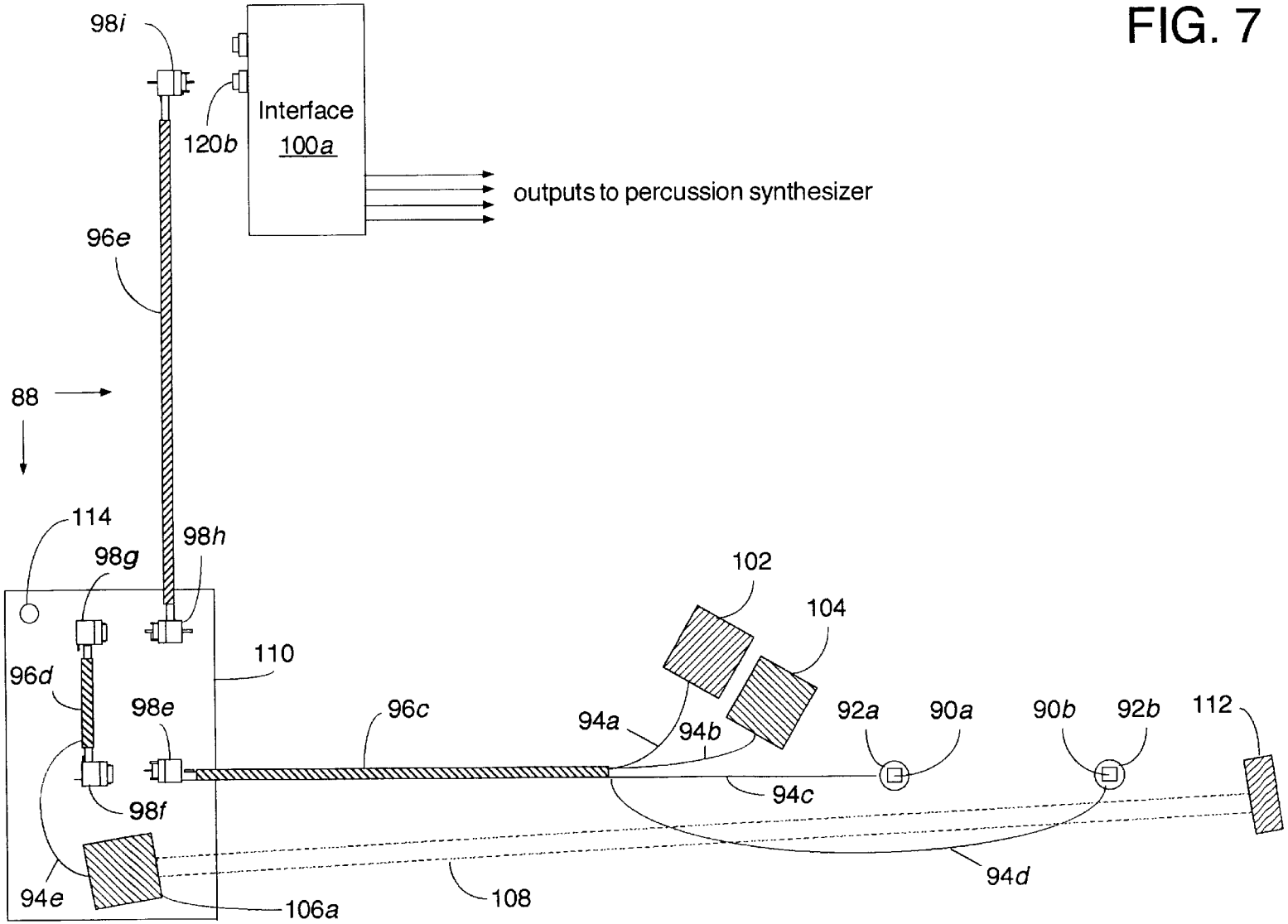
FIG. 7 shows an overview of the floor unit, connecting cables, and system interface of the present invention.

FIG. 7 shows the components of the floor unit 88 of the present invention. Two transducer triggers 90*a*–90*b*, each either of piezoelectric type or a force sensitive resistor, each within a housing 92*a*–92*b* are shown. The output signals from the transducers are transferred through designated conductors 94*a*–94*e* of multi–channel cable 96*c*–98*e* and by multi-contact connectors 98*e*–98*i*, 120*b* through components and connections of the system interface 100*a* to designated inputs of a percussion synthesizer. The instrumentalist may tap his or her feet on the transducer housings to trigger additional sounds, usually those of a bass drum, from within the percussion synthesizer that is used in conjunction with the present invention.

Patch change switch pedal 102 includes two SPST momentary switches that provide bi-directional scrolling through the percussion synthesizer patches. A hi-hat controller switch pedal 104 is also shown in FIG. 7. The signals from the patch change switch pedal and hi-hat controller switch pedal are transferred by appropriate electrical connections through the system interface 100*a* to the respective patch change and hi-hat controller inputs of a percussion synthesizer.

In order to change drum sounds while playing the instrument of the present invention, the instrumentalist may engage the switching component that is housed within the system interface 110*a* and through which the trigger output signals are transferred. The switching component is an analog switch, FET switch, or relay that alternates between two or more functions, with each function providing combinations of one or more instrument trigger outputs. The switching component alternates output functions when a signal is received from a commercially available battery-powered infrared photorelay receiver/transmitter sensor 106*a* that is placed within the path of the instrumentalist's playing area as shown in FIG. 7. The sensor signal is sent to the switching component whenever the instrumentalist breaks the invisible infrared beam 108 that is transmitted from and reflected back to the sensor. Hence, when the instrumentalist chooses to move into the path of the beam by altering his or her stance or posture slightly while he or she is playing the instrument, the switching component enables the outputs of the alternative function or functions thereby enabling a different combination of sounds within the percussion synthesizer to be triggered by the instrumentalist tapping on the instrument of the present invention. The sensor is secured to the floor unit base 110 by a screw or other fastener (not shown) that allows for free turning of the sensor when aiming the sensor at the reflector 112 that is positioned within aiming proximity of the sensor as shown in FIG. 7. A plurality of sensors may be employed in conjunction with a plurality of switching components, depending on the number of instrument trigger output functions desired. Motion, light or heat sensor/relays may be substituted for infrared sensors in the present invention.

A 1" hole 114 is shown in the floor unit base through which a finger may be placed to easily grip the floor unit when carrying. The floor unit base is made of 3/16" clear acrylic in the pictured embodiment.

As shown in FIG. 7, multi-contact connector 98*e* connects to 98*f*, 98*g* connects to 98*h*, and 98*i* connects to 120*b*. Series 516 connectors commercially available from EDAC, Inc. of Ontario, Canada are depicted.

Figure 8:
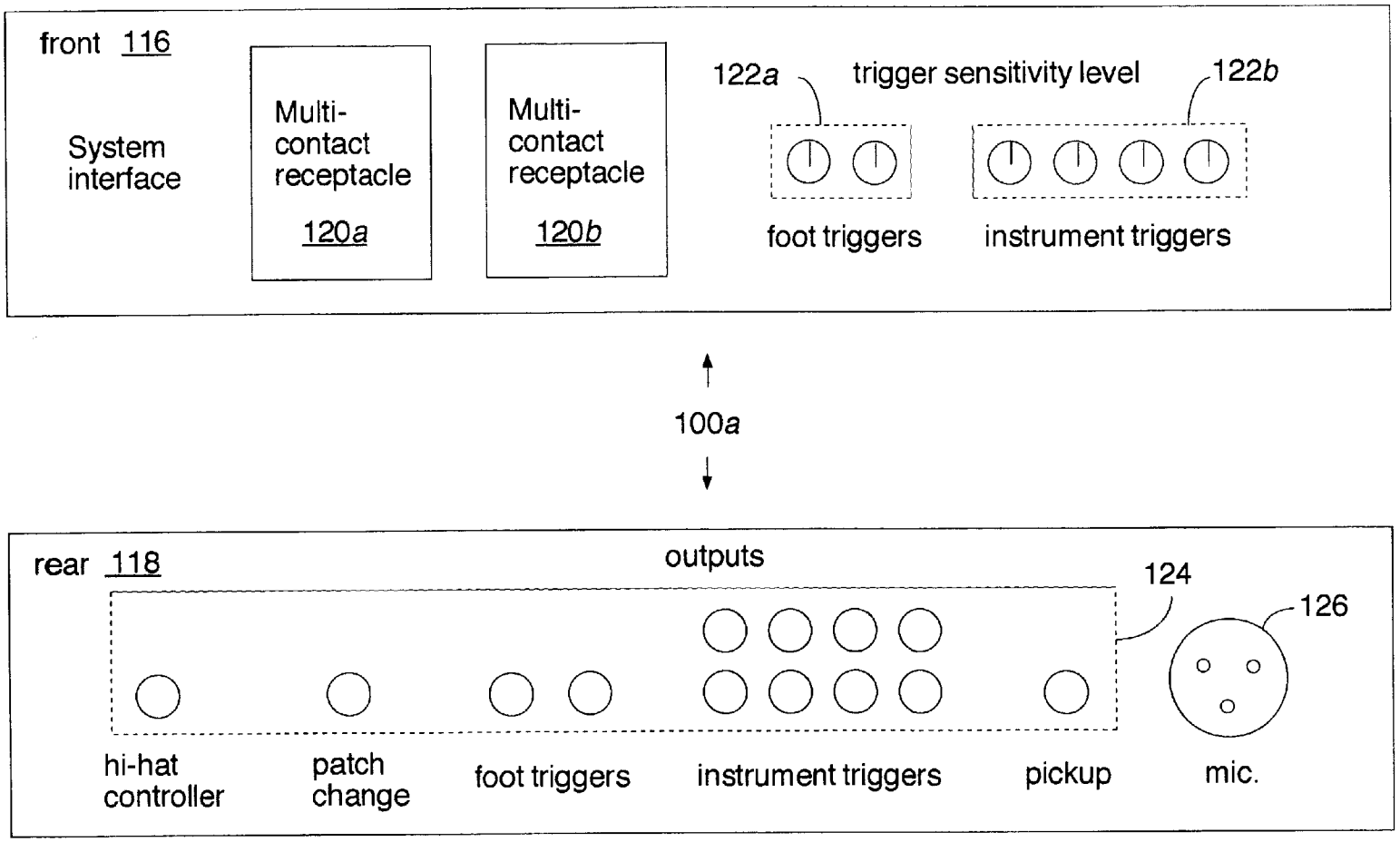
FIG. 8 details the front and back panels of the system interface of the present invention.

FIG. 8 shows the front panel 116 and rear panel 118 of the system interface 100*a*. Interface input receptacles 120*a*–120*b* connect to the instrument and floor unit connecting cables respectively. Knobs 122*a*–122*b* located on the front panel provide adjustment of foot trigger and instrument trigger sensitivity levels. A plurality of ¼" output jacks 124 located on the rear panel provide connection of interface outputs to designated preamp or percussion synthesizer inputs by standard ¼" patch cables. XLR receptacle 126 provides connection of the instrument microphone output to a mixer input by standard low-impedance connecting cable.

Figure 9:
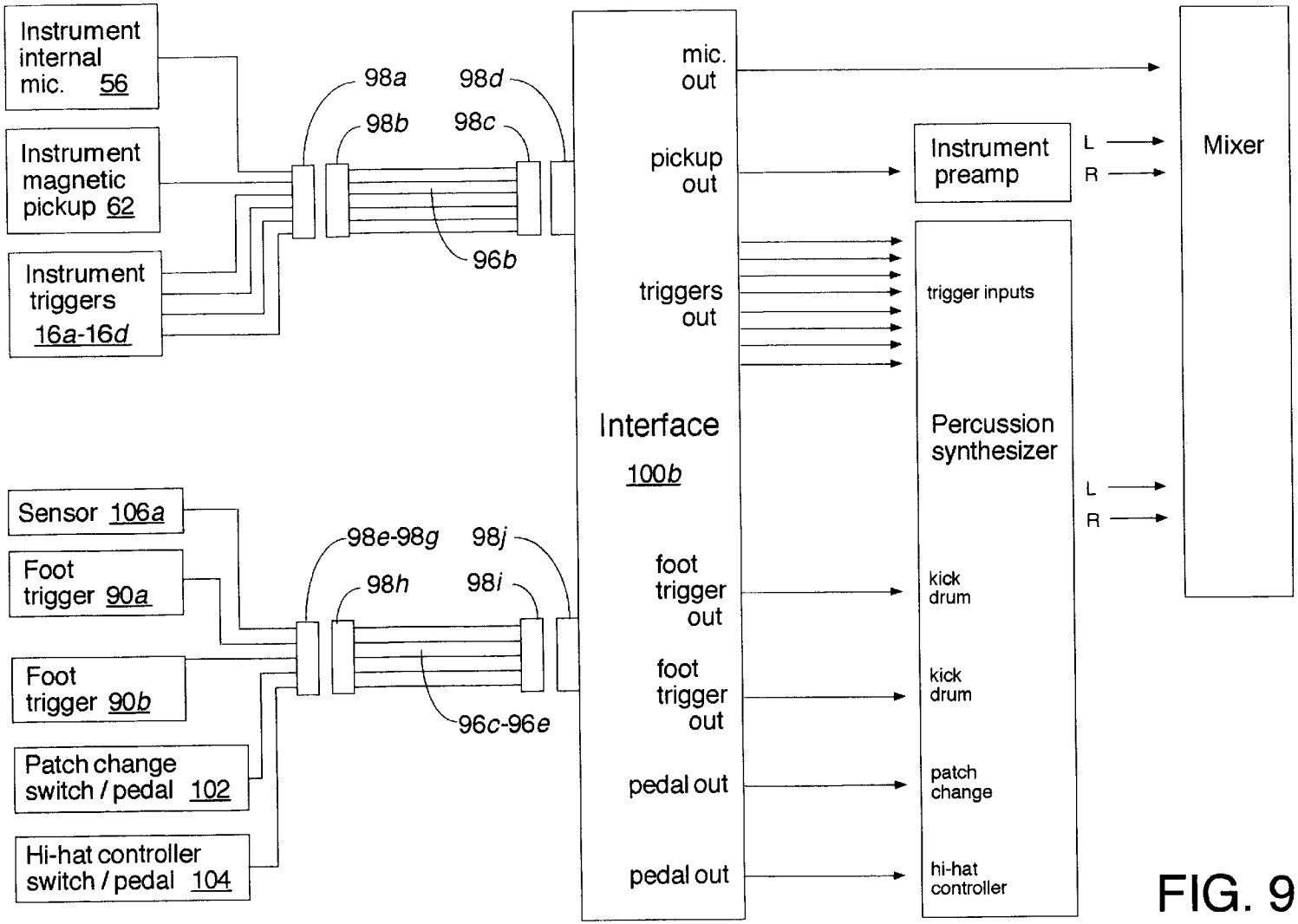
FIG. 9 shows a block diagram of the components described in Embodiment B of the present invention and their connections to an example of the external electrical signal processing system that may be used in conjunction with the present invention.

FIG. 9 shows a block diagram of the components of embodiment B of the present invention and their electrical connections to signal processing units that may be used in conjunction with the present invention. Output signals from the instrument microphone 56, pickup 62, and transducer triggers 16*a*–16*d* are transferred through designated conductors of multi-contact connectors 98*a*–98*d* and multi-channel cable 96*b* through components and connections of the system interface 100*b* to designated inputs of a preamp, mixer or percussion synthesizer.

Output signals from the sensor 106*a*, foot triggers 90*a*–90*b*, patch change switch 102, and hi-hat controller switch 104 are transferred through designated conductors of multi-contact connectors 98*e*–98*j* and multi-channel cable 96*c*–96*e* through components and connections of the system interface 100*b* to designated inputs of a percussion synthesizer.

Figure 10:
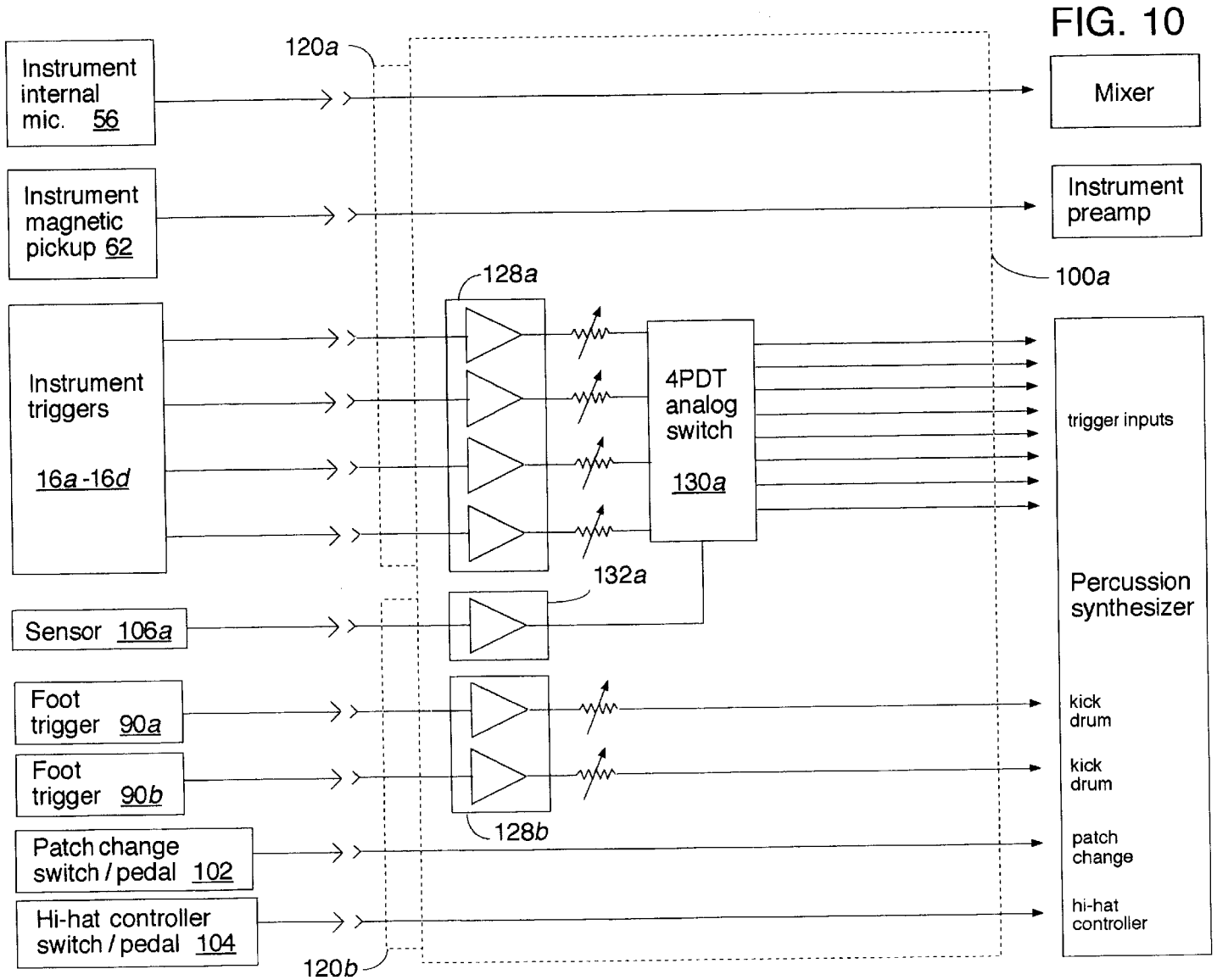
FIG. 10 shows a block diagram of the components and connections described in Embodiment A of the present invention including the inner components of the system interface and an example of the external electrical signal processing and amplification systems that may be used in conjunction with the present invention.

FIG. 10 details the inner components of the system interface 100*a* of the present invention. Output signals from the instrument and floor unit are transferred by appropriate electrical connections through interface input receptacles 120*a* and 120*b* respectively. Output signals from instrument microphone 56 and pickup 62 are transferred through interface outputs to designated mixer or preamp. Output signals from instrument triggers 16*a*–16*d* and foot triggers 90*a*–90*b* are transferred through signal conditioning and TL084 or equivalent analog operational amplifiers 128*a*–128*b* that have a variable gain to adjust the sensitivity of the triggers. Instrument trigger output signals are transferred through CD4052 or equivalent 4PDT analog switch 130*a* and through interface outputs to designated trigger inputs of a percussion synthesizer. Alternate function signals from the sensor 106*a* are transferred through signal conditioning and DM7414 or equivalent Schmitt-triggers 132*a* to the analog switch. Signals from the foot triggers, patch change switch pedal 102 and hi-hat controller switch pedal 104 are transferred through interface outputs to designated inputs of a percussion synthesizer.

Figure 11:
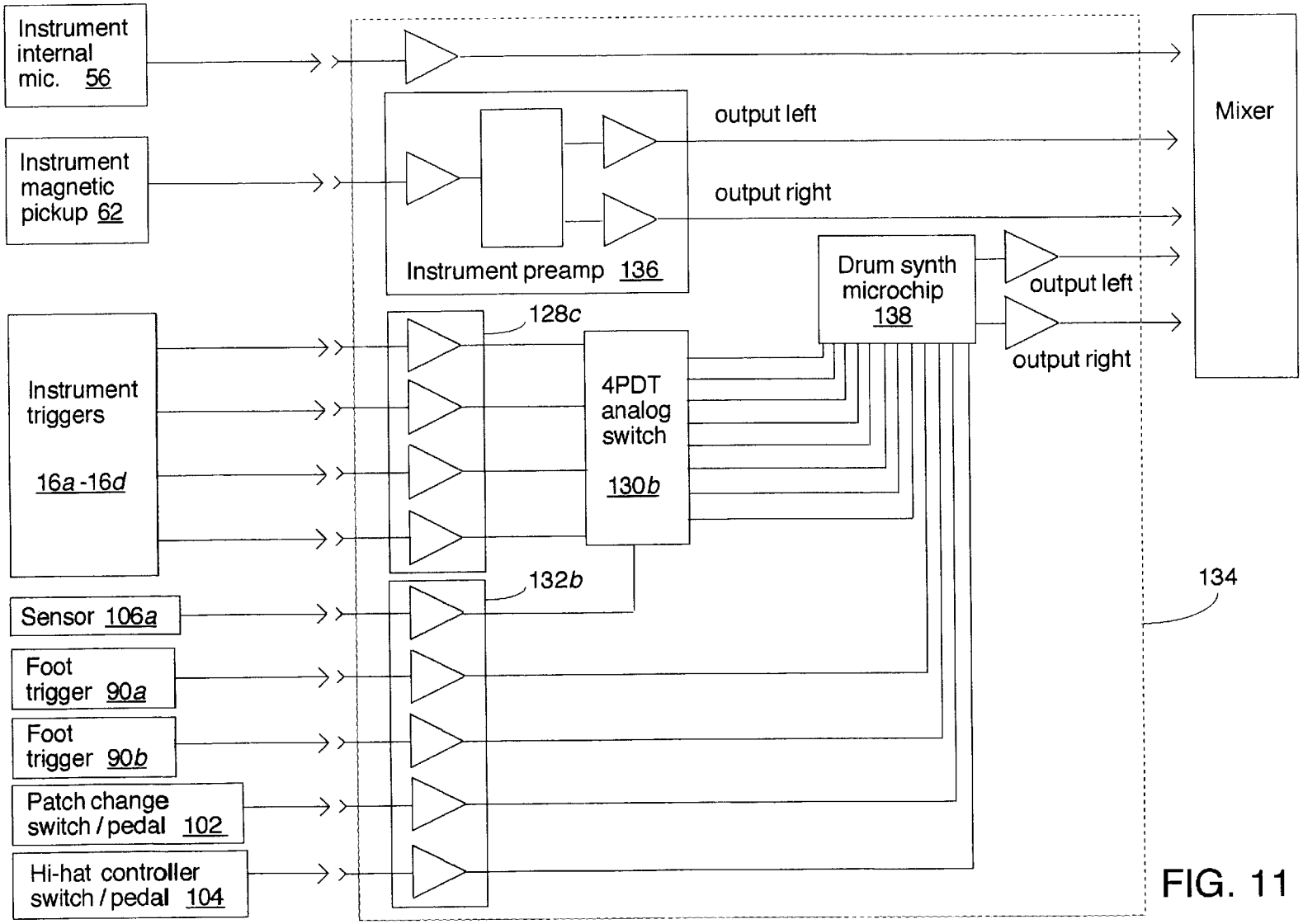
FIG. 11 shows a block diagram of components and connections described in Embodiment E of the present invention including a signal processing unit that utilizes a microchip and circuitry in place of certain components.

FIG. 11 shows a block diagram of the circuitry and connections of the components described in Embodiment E of the present invention including a miniaturized signal processing unit utilizing a microchip, electronic components and circuitry in place of certain components of Embodiment A of the present invention. Output signals from the instrument and floor unit of the present invention are transferred by appropriate electrical connections to the designated input receptacle of the signal processing unit 134. Output signals from the instrument magnetic pickup 62 are transferred through unit preamp 136 through unit outputs to designated mixer inputs. Output signals from instrument triggers 16*a*–16*d* are transferred through signal conditioning and TL084 or equivalent analog operational amplifiers 128*c* through CD4052 or equivalent 4PDT analog switch 130*b* to a custom programmed percussion synthesizer microchip 138, such as those commercially available from Kurzweil, Inc. (Lakewood, Wash.), and through unit outputs to designated mixer inputs. Alternate function signals from the sensor 106*a* are transferred through signal conditioning and DM7414 or equivalent Schmitt-triggers 132*b* to the analog switch. Output signals from foot triggers 90*a*–90*b*, patch change switch 102 and hi-hat controller switch 104 are transferred through signal conditioning and DM7414 or equivalent Schmitt-triggers 132*b* to the percussion synthesizer microchip 138.

Figure 12A:
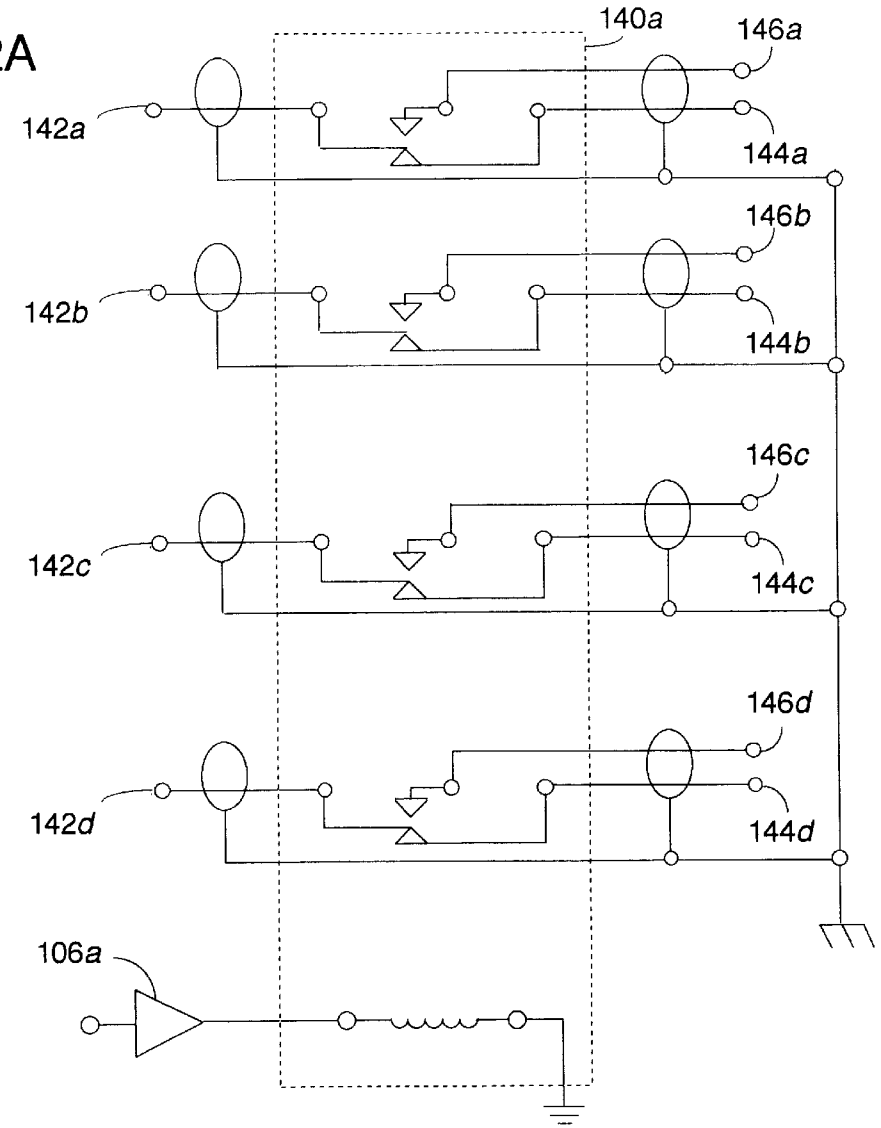
FIG. 12A shows a block diagram of the circuitry of an example of a switching component of the present invention that employs one relay and one sensor.

FIG. 12A shows a block diagram of the circuitry of an example of the switching component of the present invention. A single 4PDT relay 140*a* provides two output functions from four inputs 142*a*–142*d* with each function providing four outputs 144*a*–144*d*, 146*a*–146*d*. A single relay and sensor 106*a* are depicted though a plurality of relays may be used in conjunction with a plurality of sensors, depending on the number of output functions desired.

Figure 12B:
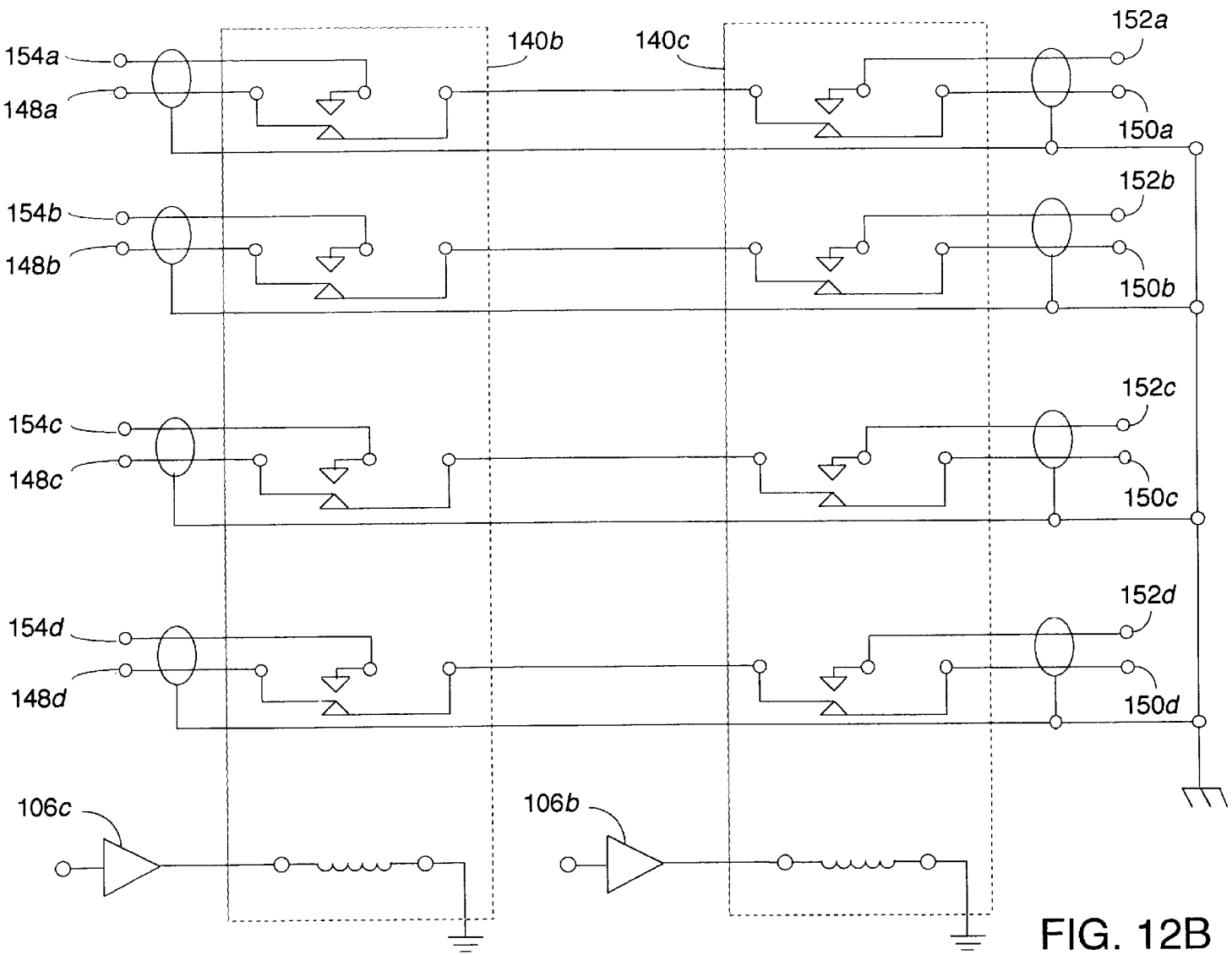
FIG. 12B shows a block diagram of the circuitry of an example of a switching component of the present invention that employs two relays and two sensors.

FIG. 12B shows a block diagram of the circuitry of another example of the switching component of the present invention. Two 4PDT relays 140*b*–140*c* provide three output functions from four inputs 148*a*–148*d* with each function providing four outputs 150*a*–150*d*, 152*a*–152*d*, 154*a*–154*d* in the pictured example in which two sensors 106*b*–106*c* are connected to respective relay coils.

Figure 13A:
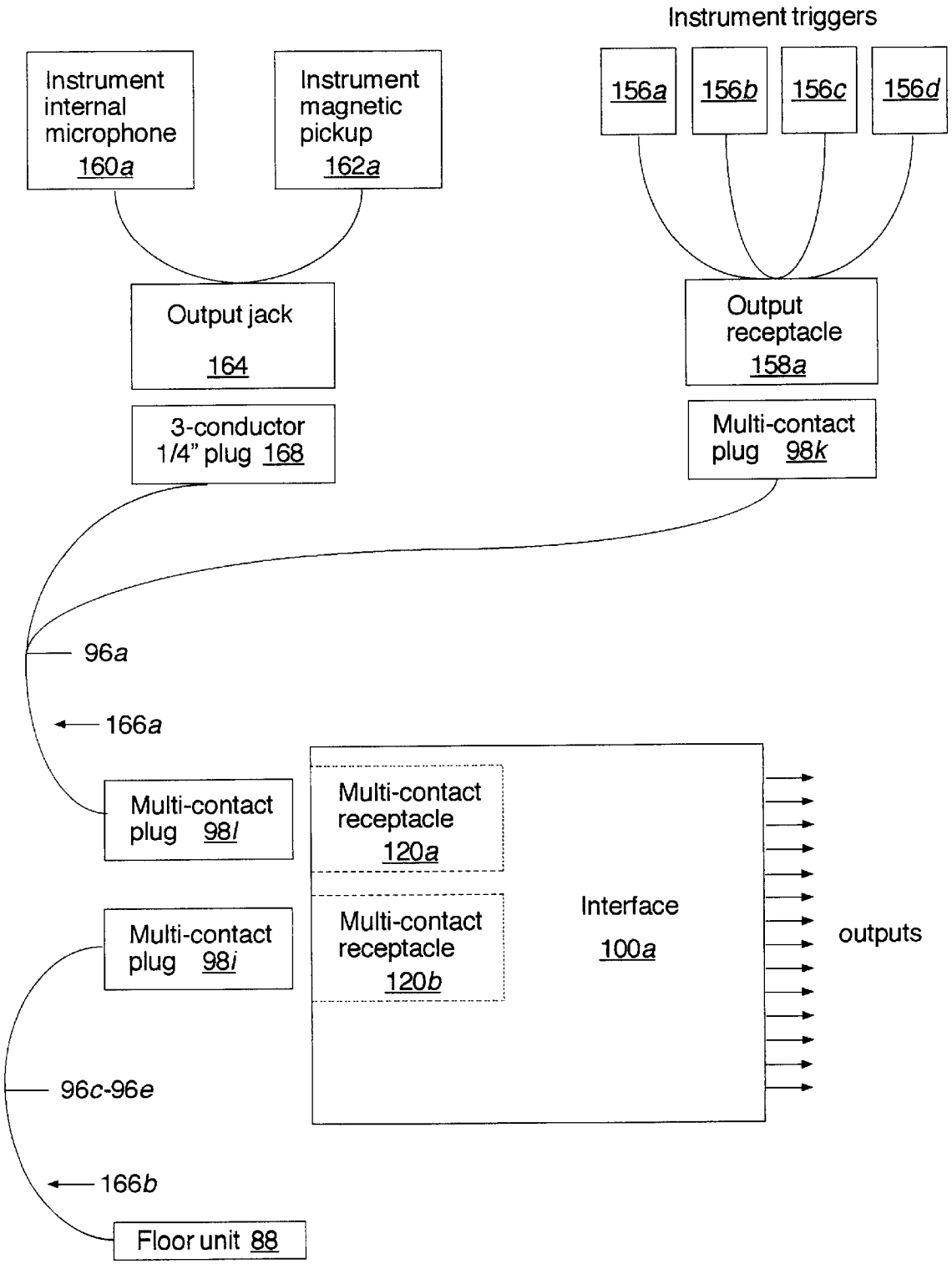
FIG. 13A shows a block diagram of components and connections described in Embodiment C of the present invention.

FIG. 13A shows a block diagram of the components and connections described in Embodiment C of the present invention. Unit triggers 156*a*–156*d*, output receptacle 158*a*, microphone 160*a*, pickup 162*a* and output jack 164 may be installed within existing hollow-body stringed instruments as shown in FIGS. 1–2. Connecting cables 166*a*–166*b* comprised of multi-channel cable 96*a*, 96*c*–96*e* and connectors 168, 98*k*, 98*l*, 98*i* transfer the output signals from the instrument microphone, pickup, triggers, and floor unit 88 to designated interface input receptacles 120*a*–120*b*.

Figure 13B:
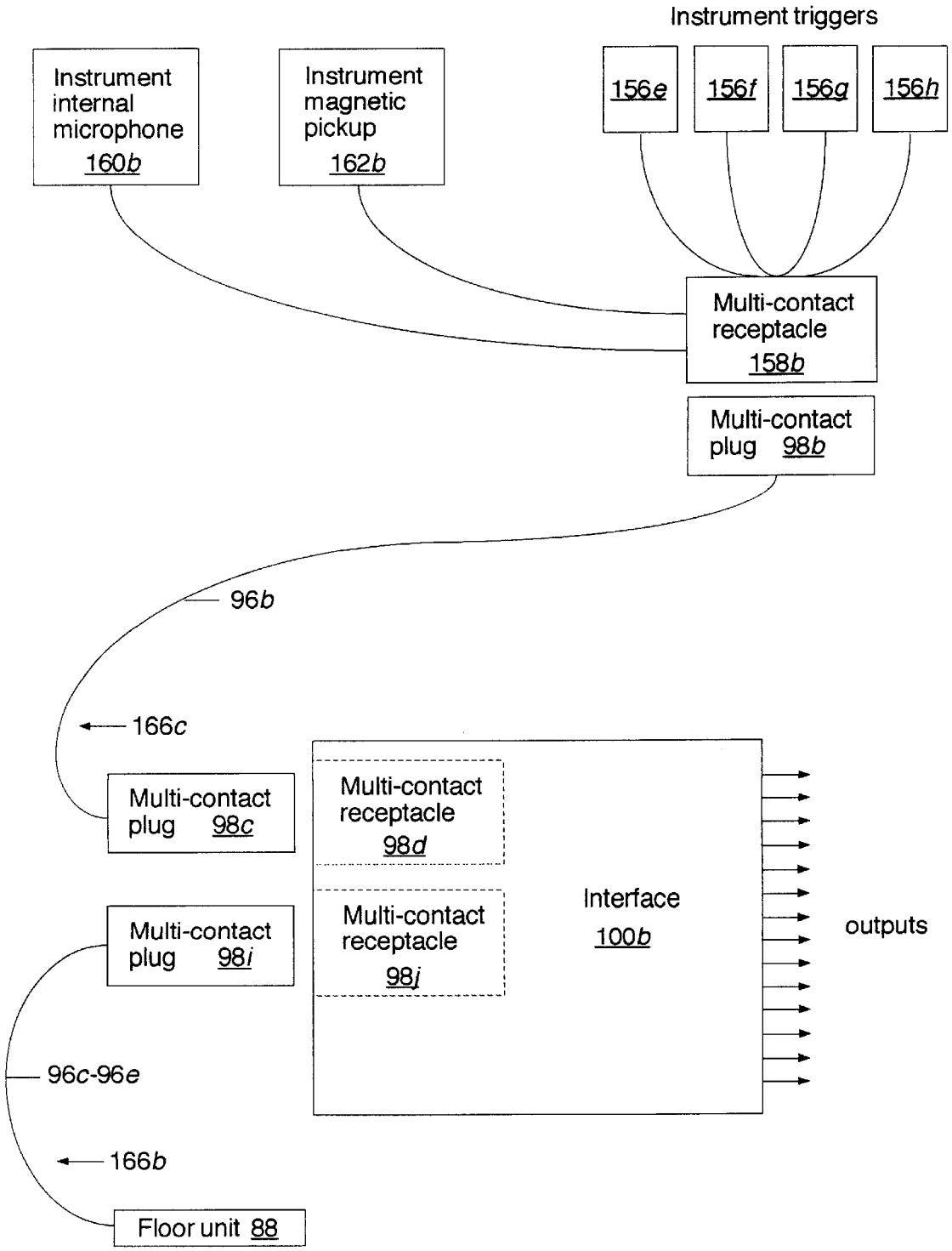
FIG. 13B shows a block diagram of components and connections described in Embodiment D of the present invention.

FIG. 13B shows a block diagram of the components and connections described in Embodiment D of the present invention. Unit triggers 156*e*–156*h*, microphone 160*b*, pickup 162*b*, and output receptacle 158*b* may be installed within existing hollow-body stringed instruments as shown in FIGS. 1–2 . Connecting cables 166*b*–166*c* comprised of multi-channel cable 96*b*, 96*c*–96*e* and connectors 98*b*–98*c*, 98*i* transfer the output signals from the instrument microphone, pickup, triggers, and floor unit 88 to designated interface input receptacles 98*d*, 98*j*.

Figure 13C:
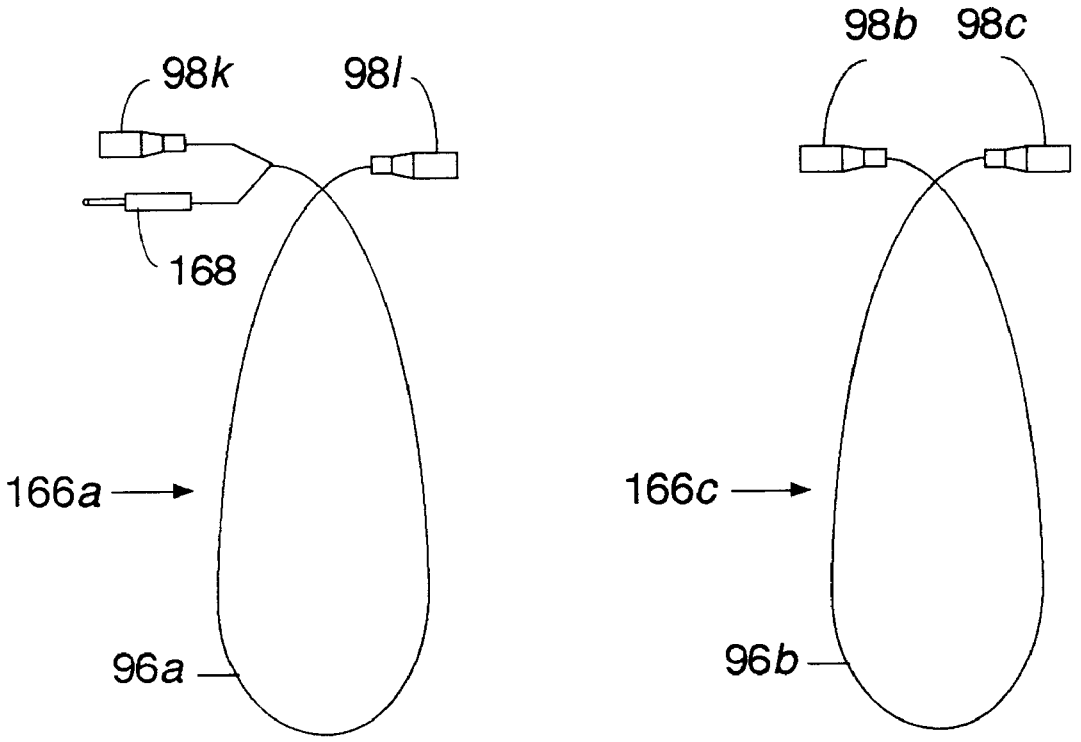
FIG. 13C shows two examples of the connecting cables that may be used with the present invention.

FIG. 13C shows two examples of connecting cables of the present invention. In cable 166*a*, multi-contact plug 98*k* and ¼" plug 168 connect to the instrument trigger output receptacle and instrument ¼" output jack respectively. Multi-contact plug 981 connects to designated interface input receptacle. In cable 166*c*, multi-contact plug 98*b* connects to the instrument output receptacle. Multi-contact plug 98*c* connects to designated interface input receptacle. Multi-channel cable 96*a*–96*b* is depicted in the pictured embodiments.

The trigger thresholds within the percussion synthesizer used in conjunction with the present invention should be set at varied levels in order to limit the response from designated triggers on the instrument while allowing more response from other designated triggers on the instrument. By doing so, the instrumentalist may trigger different sounds from within the percussion synthesizer by using more forceful or less forceful strikes on the instrument used in the present invention while he or she is playing the instrument.

Although the instrument may be played in a conventional manner, the sound quality so obtained is acceptable, but to play the instrument strings and to rhythmically alternate the sounds that are to be triggered from a percussion synthesizer, a specialized technique that is unique to the present invention has been developed. This technique, designated as the "Tap/Strum Technique" employs three ways of attacking, or playing, the instrument: the tap, the strum, and a combination of the first two, the tap/strum.

The strum is used by the instrumentalist to sound (play) the instrument strings only, and is executed by raking the fingertips across the strings with enough force to play a note or chord, but without exerting force sufficient to trigger any of the transducers attached to the instrument.

The tap is used when the instrumentalist desires to trigger a percussion sound only, and is executed by aiming a strike to the area of the instrument neck or body to which a designated transducer responds, thereby using the rhythmic execution of the tap to select and trigger a designated percussion sound from the percussion synthesizer.

The tap/strum is used to strum the instrument strings and to simultaneously trigger a percussion sound, and is executed by utilizing a rapid strike to the instrument neck that also strums the instrument strings, thereby simultaneously sounding the strings and triggering a selected sound from the percussion synthesizer. The tap/strum may be executed with only enough force to trigger percussion sounds that are set to respond to the lowest aforementioned thresholds, while a heavy tap/strum is executed to exceed all trigger thresholds and to thereby trigger all percussion sounds in any of the single previously mentioned output functions.

This technique does not employ a guitar pick or finger picks traditionally used as a plectrum with many stringed instruments. It is recommended, however, that the user protect his or her fingers and knuckles while using this technique. A suitable guard can be had by using commercially available synthetic fingernails, such as those available at a pharmacy or department store. The synthetic fingernails should be glued to the instrumentalist's natural fingernails (as recommended by the products manufacturer), but should be extended to cover the area of the finger from the tip of the fingernail to the knuckle in order to protect the entirety of the outer striking surface of the user's fingers. Additionally, a strip of sturdy tape, such as an adhesive tape, in a strip that measures approximately one-half inch by three inches, for example, may be wrapped around the area of the finger and the synthetic fingernail that lies between the cuticle and the knuckle in order to secure the unglued portion of the synthetic fingernail to the finger and to prevent hooking the unglued portion onto an instrument string when strumming or tapping the instrument used in the present invention.

By utilizing the Tap/Strum Technique to trigger drum sounds that are set to respond to varied threshold levels within a percussion synthesizer, and by alternating the functions that are available by moving into or out of the path of the beam that is transmitted from the floor unit sensor while playing the instrument, the instrumentalist may rhythmically alternate the percussion sounds of a traditional drum set or of any combination of the sounds that may be programmed into a percussion synthesizer.

Embodiments A & B

A first embodiment (Embodiment A) is shown in FIGS. 1–6. It includes a percussion triggering stringed instrument that has separate output receptacles for strings and percussion. This output configuration, shown as a block diagram in FIG. 13A, allows the strings output receptacle to be connected to an ordinary musical instrument amplifier by using common ¼ inch connecting cables if the instrument were to be used only as an electric stringed instrument such as an electric guitar. The present invention can be used on a variety of stringed instruments, provided they have a hollow body, and can be used with instruments such as an acoustic guitar, bass guitar and other stringed instruments.

Embodiment B includes a single output receptacle on the instrument to which the transducers, pickup, and microphone are wired and through which the output signals from each are transferred. This configuration, shown as a block diagram in FIG. 13B, would require a specially designed connecting cable to connect the instrument output receptacle to an amplifier. Embodiments A & B include a percussion triggering stringed instrument, floor unit, system interface, and electrical connections described herein.

Embodiments C & D

Embodiments C & D are shown as block diagrams in FIGS. 13A–13B. Both Embodiments C & D include a unit comprised of the components located within and on the body of the percussion triggering stringed instrument of the present invention. The unit may be installed within existing hollow-body stringed instruments. Embodiment C, shown as a block diagram in FIG. 13A, includes separate output receptacles for strings and percussion. Embodiment D, shown as a block diagram in FIG. 13B, includes a single output receptacle to which the transducers, pickup, and microphone are wired and through which the output signals from each are transferred. Embodiments C & D also include the floor unit, system interface, electrical connections, strap post, reinforcers and fasteners described herein.

Embodiment E

Embodiment E is shown as a block diagram in FIG. 11. It includes a signal processing unit that utilizes a custom programmed percussion synthesizer microchip, such as those commercially available from Kurzweil, Inc., and a preamp on a circuitboard in place of the aforementioned percussion synthesizer and external preamp that are used in conjunction with the present invention. Embodiment E includes a percussion triggering stringed instrument or inner components unit that is described in Embodiments A-D herein. Embodiment E also includes the signal processing unit, floor unit, electrical connections, strap post, reinforcers and fasteners described herein.

Although the interface units 100*a*–*b* are illustrated with embodiments of the present invention, an alternate embodiment of the present invention (not shown) enables the direct connection of the various outputs directly to the mixer and amplifier.

CONCLUSION, RAMIFICATIONS, AND SCOPE

This patent in part describes an instrument with pressure-sensitive transducers that are installed under the instrument fingerboard and within the instrument body during its construction. Transducer triggers may also be placed within carved-out wells in the neck block, the headstock, the endpin block, or any other solid wood surface within the instrument interior or within housings on the outer surface of the instrument during the construction of the instrument. Four piezoelectric transducer triggers are pictured in the interior of the instrument described herein, although more or fewer may be installed. Other embodiments of the present invention could include different types of connecting cables or switching components.

An outboard instrument preamp is used in conjunction with the system of the present invention instead of an onboard instrument preamp in order to minimize the amount of wood removed from the instrument body, thereby maintaining the integrity of the drum-like, cylindrical structure that comprises the body of instrument of the present invention. Onboard battery-powered instrument preamps that provide adjustment of volume, equalization and notch filter parameters, such as those commercially available from L. R. Baggs of Nipomo, Calif., may be installed in the instrument described herein if closer preamp proximity were to be the instrumentalist's priority.

To control MIDI parameters within the percussion synthesizer that is used in conjunction with the present invention, a Dimension Beam may be included in the floor unit described herein. Dimension Beam, commercially produced by Interactive Light, Inc. of Santa Monica, Calif., is a continuous controller that provides control of parameters such as pan, pitch bend, decay, etc. within MIDI compatible devices by using subdivisions of an invisible spherical beam that is projected into the instrumentalist's playing area. To control percussion synthesizer MIDI parameters, the instrumentalist would move within the beam while he or she played the instrument described herein.

In order to find the most responsive spots of the instrument of the present invention for transducer trigger placement, each transducer trigger should be tested on several locations in the interior of the instrument. Double-sided trigger tape, such as the type commercially available from Trigger Perfect of Norcross, Ga., may be used to temporarily secure each transducer trigger to the instrument while testing. After the most responsive spots of the instrument are found, the transducer triggers may be more permanently fastened to the instrument by using a thin adhesive such as silicon epoxy.

The top strap post of the instrument described herein is reinforced so that it may be used alone to suspend the weight of the instrument if the instrument is being played while held vertically. In this case, both ends of the strap would be connected to the top strap post to form a loop from which the instrument would be suspended.

Using appropriate electrical connections, an anti-feedback device may be connected between the mixer and the power amplifier that are used in conjunction with the present invention in order for high volume to be maintained without the feedback that is often produced when amplifying hollow body electric instruments. A sound system utilizing a plurality of speakers may be used.

A subharmonic synthesizer may be included in the signal-processing unit described herein to add depth to the sound of the instrument of the present invention. A subharmonic synthesizer is a processor that reproduces a note that is one octave below the lowest note present in music, thereby enabling the strings of the instrument described herein to sound an additional note in the bass register. This would fill out the sound produced by the instrument described herein to that of a live combo comprised of guitar or other stringed instrument, bass, and drums.

Impact-reducing gloves commonly used by drummers, such as those commercially available from Zildjian, and fingertip protection, such as the kind commonly used by bongo and conga players, are worn by the instrumentalist on his or her striking/strumming hand when playing the instrument of the present invention. It is recommended that the instrument described herein not be played without the use of protective hand gear.

Therefore, although this invention has been described with a certain degree of particularity, it is to be understood that the present disclosure has been made only by way of illustration and that numerous changes in the details of construction and arrangement of parts may be resorted to without departing from the spirit and scope of the invention.

I claim:

1. A system to generate a percussion sound from a stringed instrument having a body and a neck, the system comprising:

a transducing unit which is attachable to the stringed instrument, the transducing unit comprising a transducer; and a percussion synthesizer capable of generating percussion sounds, said percussion synthesizer being in communication with the transducing unit, such that when at least one of the body and the neck of the stringed instrument is struck by a user a signal is sent from the transducing unit to trigger the generation of the percussion sound from the percussion synthesizer.

2. The percussion sound generating system as described in claim 1, further comprising an interface unit in communication with the transducing unit.

3. The percussion sound generating system as described in claim 2, wherein the transducer is attached inside the stringed instrument.

4. The percussion sound generating system as described in claim 3, further comprising a microphone, the microphone being positioned in proximity to the stringed instrument.

5. The percussion sound generating system as described in claim 4, wherein the microphone is attached to the stringed instrument.

6. The percussion sound generating system as described in claim 4, further comprising a pickup.

7. The percussion sound generating system as described in claim 2, wherein the stringed instrument includes a neck, and a transducer is attached to the stringed instrument neck.

8. The percussion sound generating system as described in claim 2, wherein the transducing unit further comprises a plurality of transducers.

9. The percussion sound generating system as described in claim 2, further comprising a second transducing unit, the second transducing unit comprising a housing, and a transducer therein, the second transducing unit being in communication with the interface unit.

10. The percussion sound generating system as described in claim 9, wherein the second transducing unit further comprises a mechanism for switching sounds.

11. The percussion sound generating system as described in claim 10, wherein the mechanism for switching sounds further comprises an actuator, the actuator being a photosensitive relay.

12. The percussion sound generating system as described in claim 10, wherein the mechanism for switching sounds is an infrared relay.

13. The percussion sound generating system as described in claim 2, wherein the stringed instrument is a hollow bodied stringed instrument.

14. The percussion sound generating system as described in claim 13, wherein the stringed instrument is chosen from the group consisting of a guitar, a mandolin, a violin, a viola, a cello, a banjo, a ukelele, a stringed bass, or an electric guitar.

15. The percussion sound generating system as described in claim 14, wherein the preferred stringed instrument is a guitar.

16. The system of claim 1, wherein the signal is an electrical signal.

17. The system of claim 1, wherein the transducer is a piezoelectric transducer.

18. The system of claim 2, wherein the interface unit includes the percussion synthesizer.

19. The percussion sound generating system as described in claim 18, wherein the percussion synthesizer is a microcontroller.

20. The percussion sound generating system as described in claim 19, wherein the microcontroller further comprises a memory and a representation of the percussion sound is stored within the memory.

21. The percussion sound generating system as described in claim 19, wherein the interface unit further comprises a sound amplifier.

22. The percussion sound generating system as described in claim 21, wherein the microcontroller and the sound amplifier are connected to a sound mixer.

23. A method of generating a percussion sound, the method comprising the steps of:

a) utilizing a stringed instrument comprising a system to the percussion sound, the system comprising:

1) a transducing unit attached to the stringed instrument, the transducing unit comprising a transducer; and 2) an interface unit in communication with the transducing unit; the interface unit comprising a means for generating the percussion sound, the means for generating the percussion sound being in communication with the transducing unit;

b) setting a threshold level of the transducing unit;

c) striking the instrument at a location on the instrument, wherein the location is in communication with the transducing unit, the striking being with an amount of force sufficient to exceed the threshold level of the transducing unit, thereby sending a signal from the transducing unit through the interface and to the percussion synthesizer, whereby the percussion sound is generated.

24. The method of playing a stringed instrument to generate a percussion sound as described in claim 23, a further comprising the method of strumming the strings of the stringed instrument, thereby producing stringed instrument sounds in addition to percussion sounds.

25. A functional stringed instrument comprising:

a body;

a neck attached to the body;

a series of strings supported by the body and the neck, the strings being capable of generating sounds when struck by a user; and a transducer unit including a signal generator that generates a signal in response to at least one of the body and the neck of the stringed instrument being struck by the user, the signal being operable to trigger the generation of a percussion sound.

26. The stringed instrument of claim 25, wherein the signal is an electric signal.

27. The stringed instrument of claim 25, wherein the transducer unit includes a piezoelectric transducer.

28. The stringed instrument of claim 25, wherein the transducer unit includes a plurality of transducers.

* * * * *